US005819315A

United States Patent [19]

Ruffa

[11] Patent Number: 5,819,315

[45] Date of Patent: Oct. 13, 1998

[54] FAIRED ATHLETIC GARMENT

[75] Inventor: Anthony A. Ruffa, Hope Valley, R.I.

[73] Assignee: The United States of America as represented by the Secretary of the Navy, Washington, D.C.

[21] Appl. No.: 910,769

[22] Filed: Aug. 13, 1997

[51] Int. Cl.[6] ..... A41D 1/00

[52] U.S. Cl. ..... 2/69; 2/108; 2/115; 2/243.1

[58] Field of Search ..... 2/69, 108, 115, 2/88, 85, 93, 227, 228, 238, 67, 243.1, 106, 105

[56] References Cited

U.S. PATENT DOCUMENTS

| | | | |
|---|---|---|---|
| 5,001,782 | 3/1991 | Stewart | 2/69 |
| 5,005,218 | 4/1991 | Ganz | 2/69 |
| 5,010,589 | 4/1991 | Hamilton | 2/1 |
| 5,203,033 | 4/1993 | Sheppard, Sr. et al. | 2/69 |
| 5,274,848 | 1/1994 | Shamblin | 2/69 |
| 5,406,647 | 4/1995 | Lew | 2/69 |
| 5,734,990 | 4/1998 | Waring | 2/69 |

*Primary Examiner*—Gloria M. Hale
*Attorney, Agent, or Firm*—Michael J. McGowan; Robert W. Gauthier; Prithvi C. Lall

[57] ABSTRACT

An athletic garment for reducing undesirable aerodynamic drag associated with high speed sports such as bicycling or skiing includes a lightweight and skin tight garment portion for covering at least the torso portion of an athlete, and further includes a plurality of lightweight flexible ribbon fairings attached to the front, side, and aft portions of the garment. At a relatively low velocity point, the flexible ribbon fairings automatically flow rearwardly around the body and adjust to the flow of fluid with respect to the athlete to form an ideal fairing shape extending from the aft portion of the garment.

16 Claims, 3 Drawing Sheets

FAIRED ATHLETIC GARMENT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates generally to body garments and more specifically to an athletic garment having a plurality of flexible ribbon fairings attached thereto which adjust to the flow of fluid to form an ideal fairing shape for reducing undesirable aerodynamic drag associated with high speed sports, such as bicycling and skiing.

(2) Description of the Prior Art

Various applications for fairings have heretofore been available. In this regard, U.S. Pat. No. 3,368,514 issued to Kelly, U.S. Pat. No. 5,406,647 issued to Lew, and U.S. Pat. No. 5,371,903 issued to Lew, are the closest prior art to the subject matter of the instant invention of which the applicant is aware. The Kelly patent relates to fairings designed for the reduction of drag and vortex induced vibrations associated with various underwater sea cable applications. The Lew patents disclose wedge shaped modules used in combination with an athletic body suit for reduction of aerodynamic drag associated with speed sport athletic event activities.

The modules of the Lew patents are either a rigidly fixed part of the body suit as in the '647 patent or rigidly attached to the body suit as in the '903 patent. In either patent, the modules do not adjust to the varying speed and wind direction conditions encountered during sport activities. At slow speeds, or in sports such as skiing where the athlete's configuration changes between turning and straight runs, the fixed modules may actually impair the athlete's performance. In addition, the modules of the '647 patent would appear to add considerably to the cost of manufacturing the athletic suit and the separate purchase of the modules of the '903 patent would also add to the cost of using a faired athletic suit.

SUMMARY OF THE INVENTION

Accordingly, among the objects of the instant invention are the provision of an athletic garment having fairings which adjust to the flow of air to form an ideal fairing shape for reduction of aerodynamic drag associated with speed sport activities. Another object is the provision of an athletic garment whereby the fairings are flexible rather than fixed at a predetermined angle of attack with respect to the flow of air and thus are better able to adjust to air flow for improved aerodynamic drag reduction.

A still further object is the provision of such an athletic garment that is easy and cost-effective to manufacture and sell.

Other objects, features, and advantages of the invention shall become apparent as the description thereof proceeds when considered in connection with the accompanying illustrative drawings.

Generally, high speed sports, such as cycling and skiing, take place on a predetermined course, track, or slope, where time is a measure of success for the athletes participating in that particularly selected sporting event. Normally, a faster time is preferred, and often times the level of competition is such that a thousandth of a second will make the difference in determining each athlete's outcome. As a result, athletes are constantly looking for ways to cut the time needed to complete an event, resulting in faster performances. The instant invention discloses a novel arrangement of elongated flexible fairings for accomplishing reduction of aerodynamic drag associated with such high speed sport activities, thus resulting in faster times for the athlete.

The instant invention is directed to an athletic body garment designed for reducing undesirable aerodynamic drag associated with high speed sports such as bicycling or skiing. A plurality of flexible ribbon fairings are attached closely together to the front, side, and aft portions of the torso portion of the athletic garment, as well as the arms of the garment, whereby, at a relatively low velocity point, the ribbon fairings adjust to the flow of fluid with respect to the position of the athlete to form an optimal fairing shape for improved aerodynamic drag performance. An athletic garment having a flexible fairing arrangement such as the garment of the instant invention represents a significant improvement over the prior art because each fairing is capable of adjusting to the flow of fluid. More specifically, during movement of the athlete, each fairing shifts to the aft portion of the athletic garment in a unified touching relation to form an ideal fairing shape providing a streamlined surface for reduction of aerodynamic drag associated with high velocity speed.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
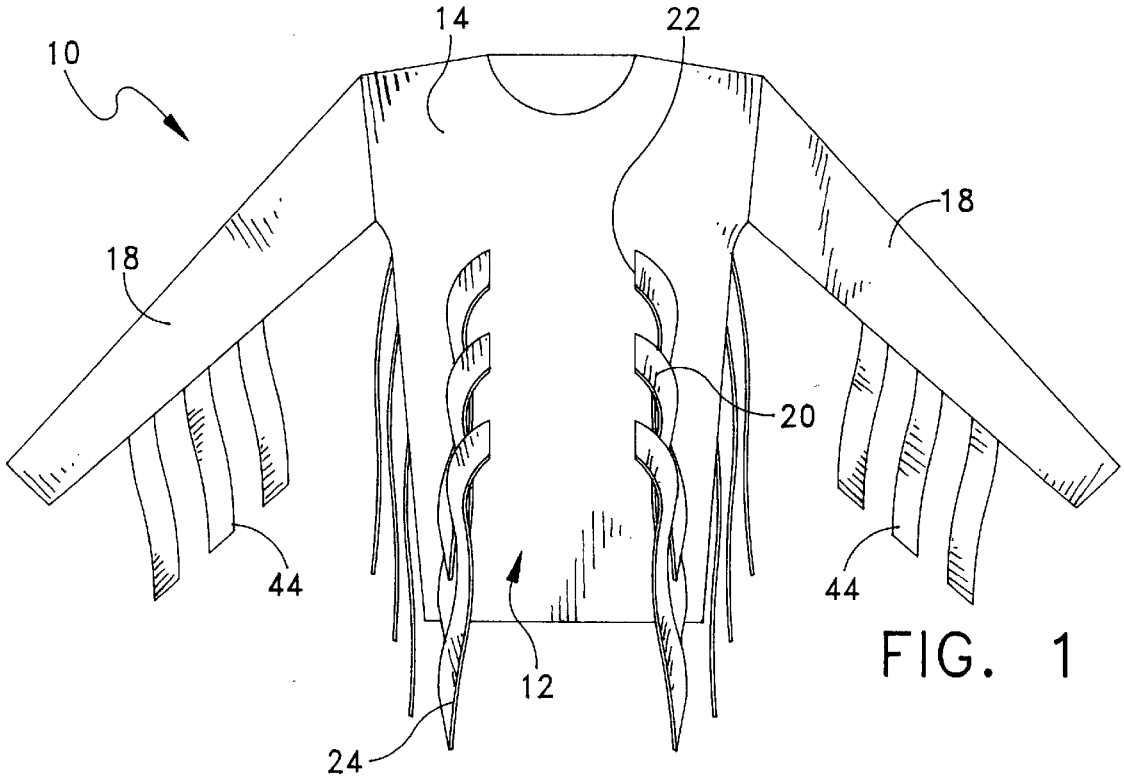
FIG. 1 is a front view of the faired athletic garment of the instant invention.
Figure 2:
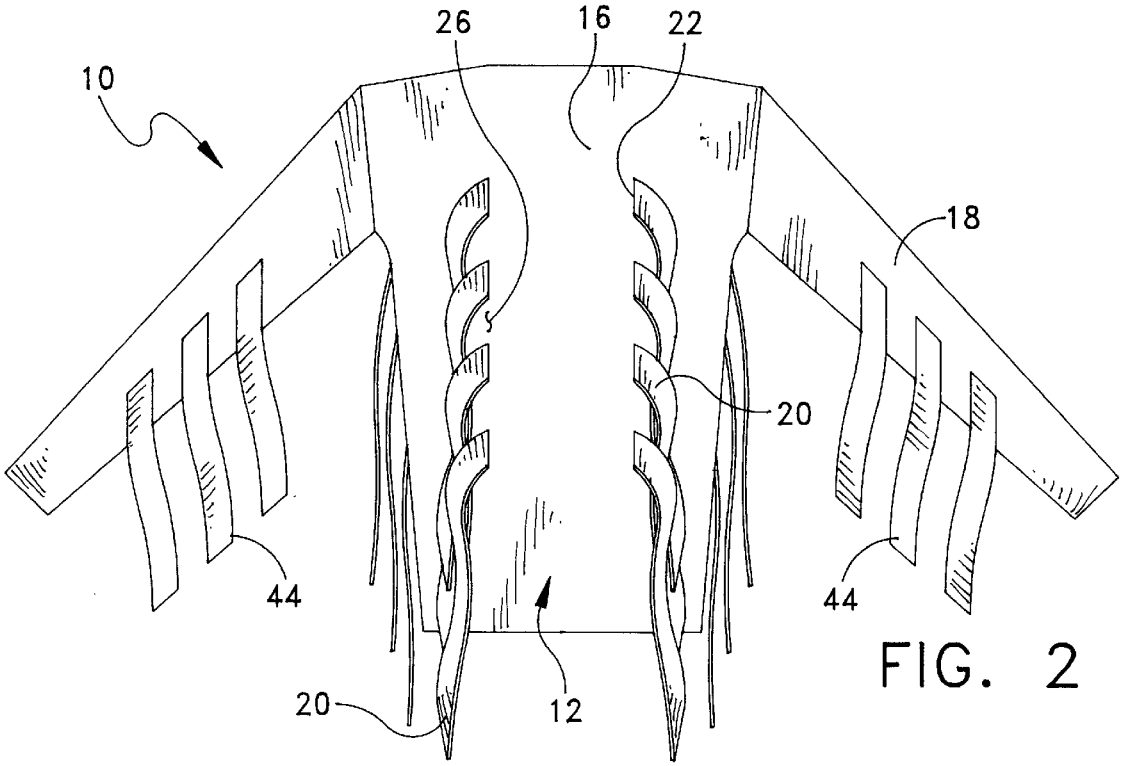
FIG. 2 is a rear view of the faired athletic garment.

Referring now to the drawings, and more particularly to FIGS. 1 and 2, the faired athletic garment of the instant invention is shown and generally indicated at 10. In the present embodiment, the garment generally comprises a trunk portion, generally indicated at 12 having a front side 14 (shown in FIG. 1), and a back side 16 (shown in FIG. 2), and two arm portions indicated at 18. Although the present garment is illustrated as a shirt, the athletic garment may also be constructed to cover the lower portions of the human body, depending on the particular application in connection with which the garment is being used. As illustrated in FIGS. 1 and 2, a plurality of flexible ribbon fairings 20 are each attached at one end thereof to the athletic garment 10 so that they hang downwardly from the front, rear, and side portions of the garment 10. In use, ribbons 20 of the faired athletic garment 10 provide aerodynamic drag reduction for improving time and performance in connection with high speed sports. The athletic garment 10 is preferably fabricated from a light weight material having characteristics for breaking aerodynamic pressure generated during any high velocity activity. More preferably, the garment 10 is fabricated from two way stretch elastic material which provides for a skin tight fit when the garment 10 is fitted over the athlete's body. It should be understood that the athletic garment 10 will vary in style, shape and size depending on the particular application, i.e., sport and climate, for which the garment is being utilized.

As shown in FIG. 2, the flexible fairings 20 are attached to the rear 16 of the athletic garment 10 in a similar manner to that depicted in the front 14 of the garment in FIG. 1. The proximate end 22 of each fairing 20 is attached to the garment 10 so as to form two sets of vertically arranged fairing rows whereby the distal end 24 of each fairing 20 remains free and hangs downwardly when the athletic garment 10 is not in use. The fairings 20 may be fabricated from any suitable lightweight material, and may be attached to the athletic garment 10 in any suitable manner, i.e., sewn thereto so as to be fixedly attached to perform the intended function. The optimum length of each fairing, as developed in the art of cable fairing, should be three to five times the width of the unfaired body. However, the length of the fairings will have limiting constraints in particular applications. For example, the fairings must be sized so that they will not get caught in the spokes of the bicycle wheel when the garment is worn by a cyclist. However, even a shorter length fairing, having a lengths one-half to one times the width of the unfaired body, would still provide some reduction in the pressure drag. The optimal number and spacing of the fairings 20 should be such that the entire surface normal to the flow of fluid is faired without gaps. Once again, other constraints may not allow for the optimum arrangement of fairings 20. However, the smaller the gap 26 between each fairing 20, the more drag reduction is achieved.

Figure 3:
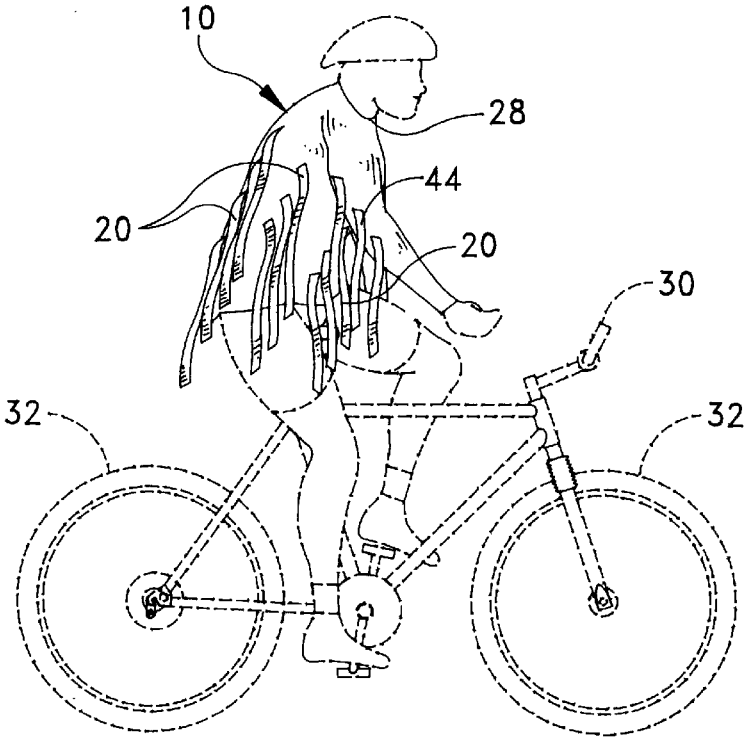
FIG. 3 is a side view of the faired athletic garment as worn by a cyclist in a stationary position.

As shown in FIG. 3, a bicyclist 28 is sitting in a substantially upright position on a bicycle 30 which is in a stationary position. As can be seen, when there is no velocity, the fairings 20 hang downwardly and rest by the sides of the athletic garment 10, remaining out of the way of the cyclist 28 and the wheels 32 of the bicycle 30.

Figure 4:
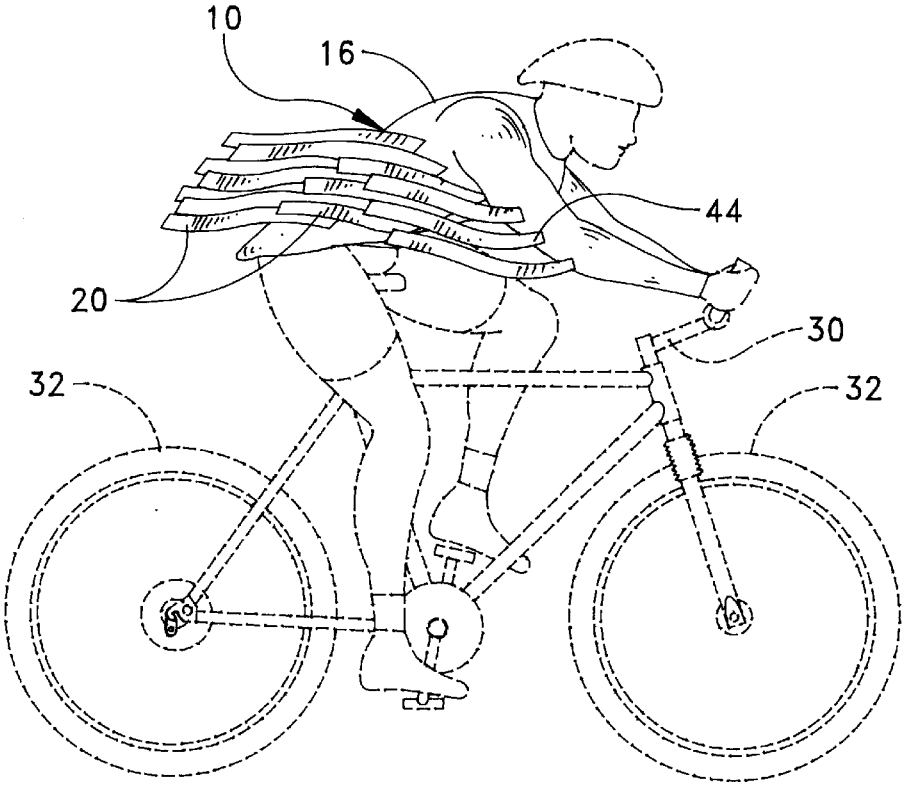
FIG. 4 is another side view illustrating deployment of the ribbon fairings during movement of the athlete.
Figure 5:
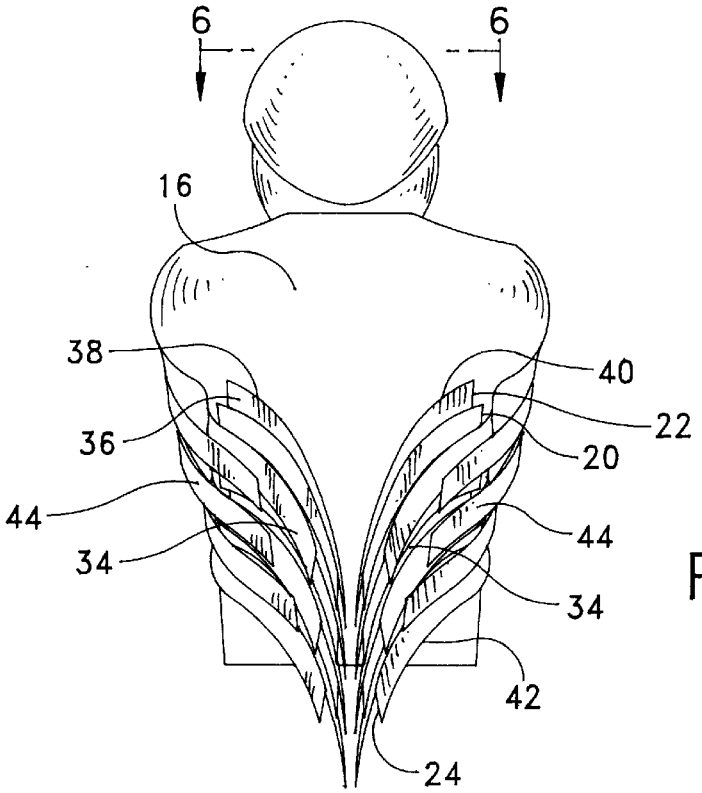
FIG. 5 is a rear view illustrating the fairing shape during movement of the athlete.
Figure 6:
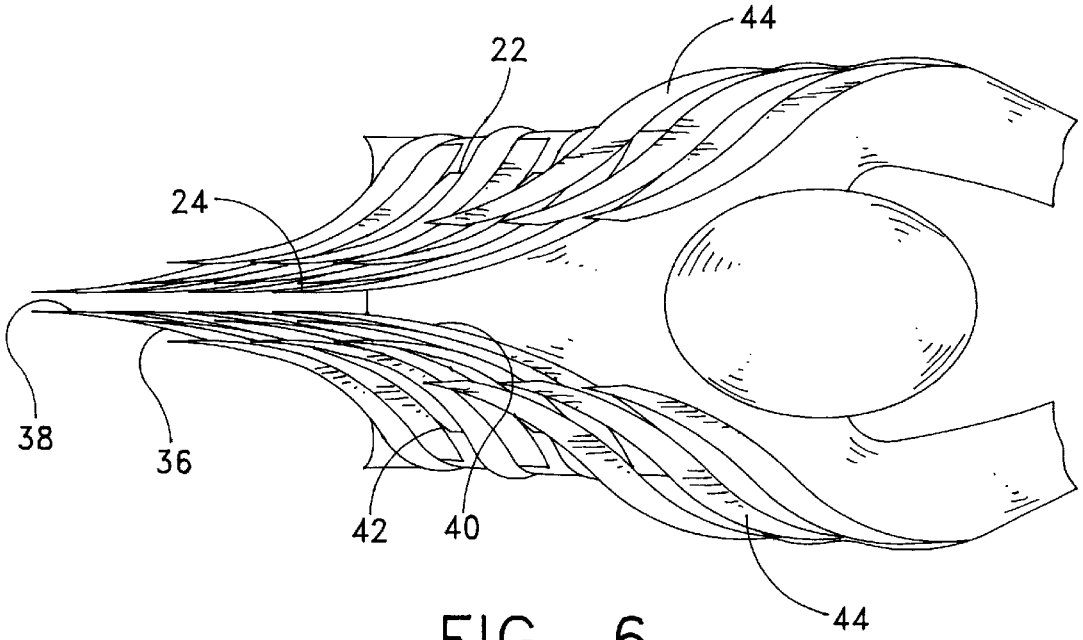
FIG. 6 is a top view illustrating the fairing shape.

FIGS. 4–6 illustrate the athletic garment 10 in use during movement of the bicycle. As illustrated in FIG. 4, the fairings 20 are attached to the front, rear, and sides of the athletic garment 10 and extend rearwardly from the torso portion of the athlete. When an identified velocity point is reached, the flexible fairings automatically adjust to the air flow to wrap around the upper portion of the human body thereby providing a streamlined surface 34 for improved aerodynamic pressure drag reduction. The velocity at which the fairings adjust to the air flow, or deploy, is sufficiently low such that drag, including the increased drag resulting from undeployed fairings, is not a major factor in the athlete's performance. Once deployed, the fairings serve to reduce overall drag.

Each oppositely aligned fairing 20 has opposing first 36 and second 38 side surfaces with leading 40 and trailing 42 edges and proximate 22 and distal 24 ends forming a generally elongated rectangular shape. Further, the distal ends 24 of oppositely positioned aligned fairings 20 are in a touching and unified relationship to one another which provide the streamlined surface 34 and form an optimal fairing shape extending from the back side 16 of the athletic garment 10. Specifically, the trailing edge 42 of the uppermost positioned aligned fairing 20 is adjacent to and in touching parallel relation with each of the below adjacent fairings.

The major advantage of the instant faired athletic garment 10 resides in the elongated fairing shape and flexibility of the fairings 20 associated with the garment 10. Although an athletic garment with a slightly more rigid fairing would result in better aerodynamic drag reduction, such a fairing is not able to adjust to the flow of fluid with respect to changes in the athlete's body position. As shown in FIGS. 4–6, when the identified velocity point is reached the fairings extend outwardly from the rear 16 portion of the athletic garment 10 so that they are in unified touching relation forming a streamlined surface 34 and ideal fairing shape for reduction of pressure drag. Although the ribbon fairings 20 do increase the skin friction drag because of the increased surface area in contact with the flow of fluid, the total drag is reduced, since the pressure drag is typically several orders of magnitude greater than the skin friction drag. FIGS. 4–6 also illustrate the placement of arm fairings 44. Similar fairings may also be attached to the leg portions of an athletic suit, where they would not present a hazard to the performance of the sport.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An athletic garment for reducing undesirable pressure drag associated with high velocity speed sports such as bicycle racing and ski racing, said athletic garment comprising:

garment means for covering at least a torso portion of a body of an athlete; and a plurality of elongate flexible ribbon fairings attached to said garment means, said flexible ribbon fairings automatically adjusting to the flow of fluid during movement of the athlete to form a substantially continuous fairing shape extending rearwardly from the aft portion of said athletic garment.

2. An athletic garment as set forth in claim 1 wherein said garment means is preferably fabricated from a light weight and skin tight material.

3. An athletic garment as set forth in claim 1 wherein said fairings have an optimal length of three to five times the width of the unfaired body.

4. An athletic garment as set forth in claim 1 wherein said fairings have a length of at least 5 times the width of the unfaired body.

5. An athletic garment as set forth in claim 1 wherein said fairings are attached to the front, side, and aft portions of said garment.

6. An athletic garment as set forth in claim 1 wherein said fairings are closely spaced along the length of the torso portion of the athlete.

7. An athletic garment as set forth in claim 6 wherein adjacent edges of adjacent fairings overlap during deployment to form a continuous fairing surface.

8. An athletic garment as set forth in claim 3 wherein said fairings are closely spaced along the length of the torso portion of the athlete.

9. An athletic garment as set forth in claim 8 wherein adjacent edges of adjacent fairings overlap during deployment to form a continuous fairing surface.

10. An athletic garment as set forth in claim 4 wherein said fairings are closely spaced along the length of the torso portion of the athlete.

11. An athletic garment as set forth in claim 10 wherein adjacent edges of adjacent fairings overlap during deployment to form a continuous fairing surface.

12. An athletic garment as set forth in claim 5 wherein said fairings are closely spaced along the length of the torso portion of the athlete.

13. An athletic garment as set forth in claim 12 wherein adjacent edges of adjacent fairings overlap during deployment to form a continuous fairing surface.

14. An athletic garment as set forth in claim 5, wherein said fairing are attached to arm and leg portions of said garment.

15. An athletic garment as set forth in claim 14, wherein said fairing are closely spaced along the length of the torso, the arm and the leg portions of the athlete.

16. An athletic garment as set forth in claim 15, wherein adjacent edges of adjacent fairings overlap during deployment to form a continuous fairing surface.

* * * * *